United States Patent [19]

Cohen

[11] 4,180,934

[45] Jan. 1, 1980

[54] PERFORATED STENCIL SIGN PANEL

[76] Inventor: Seymour Cohen, 9629 Cresta Dr., Los Angeles, Calif. 90035

[21] Appl. No.: 786,794

[22] Filed: Apr. 12, 1977

[51] Int. Cl.[2] ..... G09F 13/05

[52] U.S. Cl. ..... 40/580; 40/611

[58] Field of Search ..... 40/603, 604, 155, 156, 40/580, 579, 611; 160/377

[56] References Cited

U.S. PATENT DOCUMENTS

| | | | |
|---|---|---|---|
| 478,204 | 5/1892 | McGimsey | 40/580 |
| 2,557,402 | 6/1951 | Altheimer | 40/135 |
| 2,601,734 | 7/1952 | Couzinet | 40/155 |
| 3,024,552 | 3/1962 | MacLea | 40/129 C |
| 3,063,182 | 11/1962 | Dowd | 40/135 |
| 3,075,492 | 1/1963 | Winfrey | 40/129 C X |
| 3,239,957 | 3/1966 | Snediker | 40/125 G X |
| 3,255,725 | 6/1966 | Von Kreidner et al. | 40/579 |
| 3,831,304 | 8/1974 | Miller et al. | 40/125 G |

*Primary Examiner*—Louis G. Mancene
*Assistant Examiner*—Wenceslao J. Contreras
*Attorney, Agent, or Firm*—Freilich, Hornbaker, Wasserman, Rosen & Fernandez

[57] ABSTRACT

A marquee false front consists of a sheet of pennant cloth of one color, e.g. yellow, of dimensions equal to those of the desired marquee false front. The front surface of the sheet, except for letters-defining areas, is coated with matter which inhibits light passage through it. The matter's color is one, contrasting with the pennant cloth's color. Pockets are formed around the sheet's periphery about its back side. These pockets accept interlocking rods, which together form a frame, used to taut the pennant cloth sheet as well as to attach it to a marquee to form its false front.

3 Claims, 6 Drawing Figures

PERFORATED STENCIL SIGN PANEL

BACKGROUND OF THE INVENTION

1. Field of the Invention:

The present invention generally relates to display devices and, more particularly, to a novel false front for a marquee and the method of making it.

2. Description of the Prior Art:

Practically all theatres, e.g. movie theatres or houses, have a marquee which is used to display the name of the movie, and the leading actors, as well as other information, and display designs designed to attract potential moviegoers. An old technique which has been used to display such information consists of attaching separate letters by means of clips to flanges, known as tracks, of the marquee. One disadvantage of such an arrangement is that it is time consuming. Also the marquee tracks are visible which affects the aesthetics of the marquee.

Another technique which has been used is one known in the theatre display art as the reverse marquee or the marquee false front. In this technique the front side of the marquee is covered by a large wall board into which the desired letters and/or designs are cut. The board is relatively stiff and nontransparent. The front side of the board is painted with a color, e.g. black, which would contrast with the desired colors such as yellow, of the letters to be displayed. Then pieces of pennant cloth of the desired colors of the letters are glued to the back of the wall board to cover the letters' (or designs) openings. As is known, pennant cloth is semitransparent as well as reflects any light directed thereto. The board is then mounted to form the marquee front face or side. Any light, either natural or artificial, which is directed to the wall board is reflected by the pennant cloth which is exposed through the letters' openings in the wall board, thus producing the desired effect. Also, any artificial light from the back of the board passes through the pennant cloth thus displaying the letters. Pennant cloth is a vinyl coated cotton sheeting which is flame resistant. It is very light. Typical pennant cloth weighs about one ounce per square foot.

Although at present such marquee false fronts are used extensively, they are characterized by several disadvantages and limitations. The average marquee front side area is on the order of 60 or more square feet (e.g. 12'×5') and the wall board is relatively stiff, typically made of composition matter or plywood of 0.125 inch or more. Thus the shipment of such a board to the theatre presents a serious problem. Typically a truck with a sufficiently large bed is required. Quite often, due to the size of the desired false front, the wall board consists of several sections. Also the board is quite heavy and therefore its installation on the marquee requires several workers. In addition, due to the several steps required to produce the false front, made with a stiff wall board, its cost is relatively high.

OBJECTS AND SUMMARY OF THE INVENTION

It is a primary object of the present invention to provide a novel marquee false front, which eliminates the disadvantages of the prior art.

Another object of the invention is to provide a marquee false front which is lightweight and can be shipped easily and conveniently.

A further object of the invention is to provide a relatively inexpensive, illuminable display device of substantial display area, which is lightweight, and can be shipped without any difficulty to the display location.

Yet a further object is to provide a new method of fabricating a marquee false front or the like.

These and other objects are achieved in one embodiment in which a marquee false front is produced entirely from pennant cloth, or like material. A sheet of pennant cloth of an area not less than the desired display area is provided. The sheet may consist of strips of pennant cloth of different colors which are sewn together. The entire front surface of the pennant-cloth sheet, except for the areas where the letters to be displayed are to appear, is treated to be opaque and of a color which contrasts with the one or more colors of the one or more pennant cloth strips used to form the pennant-cloth sheet. When the false front, made of the single sheet of pennant cloth is mounted, the letters are clearly displayed, due to light, which is either reflected from the portions of the pennant cloth which define the letters or due to light which passes through the pennant cloth portions which define the letters.

Since pennant cloth is lightweight and foldable, like any relatively thin cloth, the pennant-cloth sheet can be folded up and shipped quite conveniently. Also, since pennant cloth is relatively inexpensive, the cost of the finished false front, in accordance with the present invention, is considerably less than one incorporating a wall board. Also, since pennant cloth is lightweight, the installation of the front on the marquee can be accomplished by only one person. Various techniques may be used to fasten the rollable false front on the marquee. In one embodiment of the invention pockets are formed along the edges of the sheet of the pennant cloth. These pockets are used to accomodate support rods which are interconnectable to form a tauting frame for the sheet. Clips, or other means, may then be used to attach the frame to tracks of the marquee.

The novel features of the invention are set forth with particularity in the appended claims. The invention will best be understood from the following description when read in conjunction with the accompanying drawings.

DESCRIPTION OF THE PREFERRED EMBODIMENTS

Figure 1:
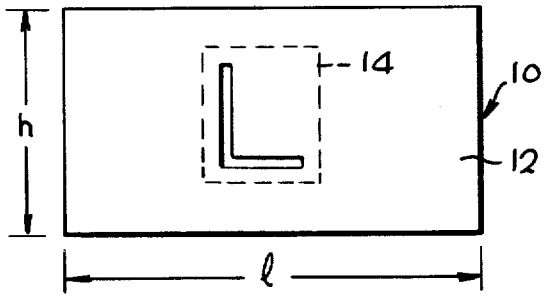
Fig. 1 PRIOR ART
FIGS. 1 and 2 are top and isometric views of a typical prior art false front using a wall board.
Figure 2:
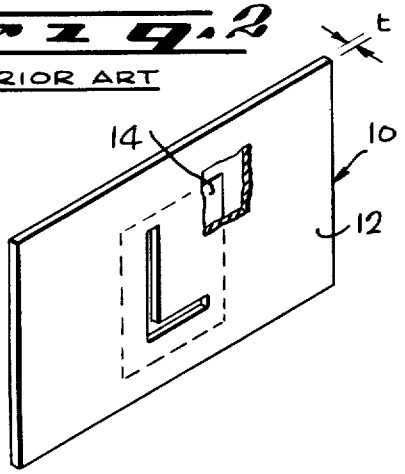
Fig. 2 PRIOR ART

The significant novel and advantageous features of the present invention may be highlighted by first describing the present, most-advanced state of the art of marquee false fronts in connection with FIGS. 1 and 2. Typically the false front is formed from a large wall board 10, of composition matter or plywood of a sufficient thickness t, e.g., 0.148 inch. The board height (h) and length (l) dimensions are chosen to match the desired dimensions of the false front. The area (h×l) of the front surface 12 is generally on the order of tens of square feet, e.g., 60 square feet or more. Since the board 10 is relatively stiff it clearly cannot be folded. Thus, its shipment to the installation site presents a serious problem.

The letters to be displayed, represented by the single L, are cut through the board from the front to the back side. The opening of each letter is then covered with a patch 14 of semitransparent and reflective material of a selected color, e.g., yellow, chosen to contrast with the color of the front side of the board 10. As previously stated, one type of material which is being used extensively is pennant cloth.

When the board 10 is mounted on the front face of a marquee any light directed to the board is reflected by the pennant cloth through the openings in the board, which form the letters. Also, any light from the back side of the board passes through the patches of the pennant cloth and the letters' openings thereby clearly displaying the letters in a pleasant and distinct way. Patches of different colors may be used to display different words in different colors. Also, in addition to, or in place of, letters, various designs may be displayed.

Since the board 10 is relatively stiff and when being of a large square area, it can only be shipped by a vehicle of sufficient bed size, e.g., a truck. Also, such a board is relatively heavy. Assuming a typical board of composition matter of a thickness of about 0.148 inch weighing about 0.5 pound per square foot, a board of 12 feet long and 5 feet high weighs about 30 pounds. The installation of such a large board generally requires more than one person.

Figure 3:
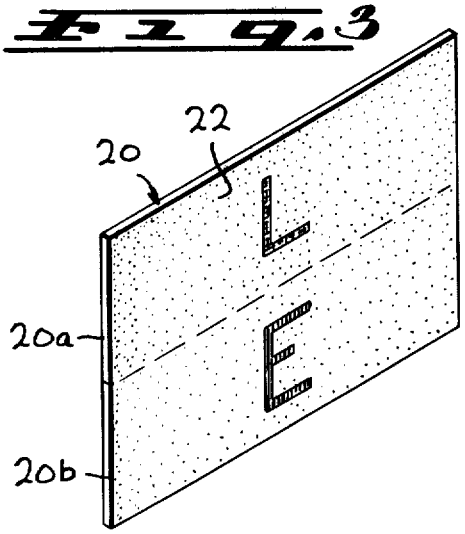
FIGS. 3 and 4 are isometric and top views of one embodiment of the invention.
Figure 4:
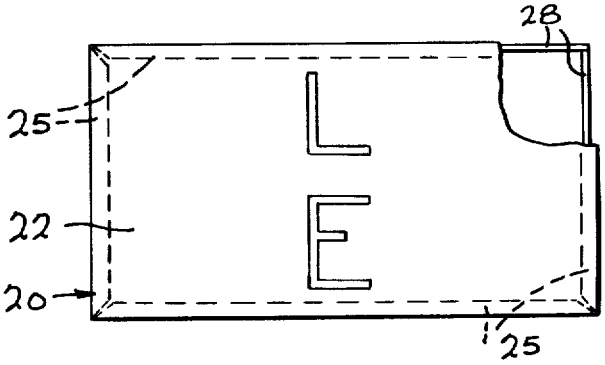
Figure 5:
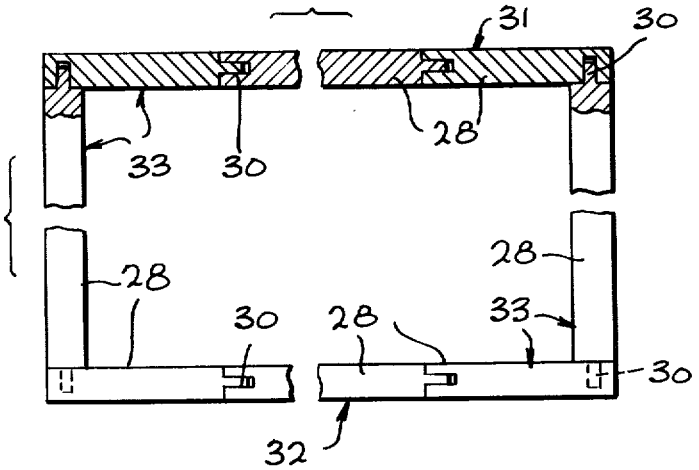
FIGS. 5 and 6 are diagrams of a sheet-tauting support frame and the manner of attaching it to a marquee.

Unlike the prior art, the present invention eliminates the problem of shipment of the false front and greatly simplifies its installation, so that it can be performed by one person. Attention is now directed to FIGS. 3–5 in connection with which one embodiment of the invention will be described. In this embodiment of the invention, the marquee false front is made to form a single sheet 20 (see FIG. 3) of relatively thin pennant cloth of a selected color, e.g., yellow. The dimensions of sheet 20, i.e., its length and heighth, are chosen to be at least equal to those of the desired false front. The sheet 20 actually replaces and eliminates the need for the stiff board 10 as well as patches 14.

The front surface 22 of sheet 20 is treated so that except for the locations of the desired letters, such as the L and the E shown in FIG. 3, the rest of the front surface area is coated to become opaque and of a color, e.g., black, chosen to contrast with the color of the pennant cloth. The coating of the surface except for the letters' locations may be achieved by any of many known techniques, such as silk screening or the like. For example, letter masks may be placed on the front surface 22 and then any exposed surface thereof painted black with an appropriate paint to cause the painted surface to become opaque. The sheet, once so treated, is the desired false front.

Since pennant cloth is flexible, like any other cloth material, sheet 20 can be rolled up to form a small cylinder, for ease of shipment. Also, since pennant cloth is very light, the entire sheet weighs only a small fraction of the weight of the prior art type false front with a wall board as herebefore described. As an example, a sheet of pennant cloth of 5'×12' weighs less than four pounds, as compared with 40 pounds for an equal size board. The 5'×12' pennant cloth sheet can be rolled up into a cylinder, five feet high and less than 4 inches in diameter. Such a sheet can be shipped in an appropriate tube as parcel post, similar to the manner rolled-up posters or paintings are shipped. At the location site a single worker can install the sheet, tautly onto the marquee to form its front face.

In one embodiment after the sheet 20 is treated as herebefore described its edges on all sides are folded over to form pockets 25 (see FIG. 4) on the back side of the sheet. These pockets are used to accomodate support members 28, shown on the right hand corner of FIG. 4 wherein the corner of the sheet 20 is shown cut away. The support members 28 may be square rods (see FIG. 5) of appropriate length. When shipped, together with rolled-up sheet 20, the rods 28 may be limited in height to be about equal to the height of sheet 20. By providing interlocking means 30 (see FIG. 5) at the ends of the rods, several short rods may be interlocked to form the long top and bottom support units 31 and 32 for the sheet 20.

In practice the top and bottom support units 31 and 32 are first assembled at the installation site. Then they are inserted into the top and bottom pockets 25. Then the side members 28 are inserted into the side pockets 25, and interconnect the two units 31 and 32 so as to form a rectangular frame 33, in which the sheet 20 is taut. The frame 33 can be attached to the marquee by any conventional means.

Figure 6:
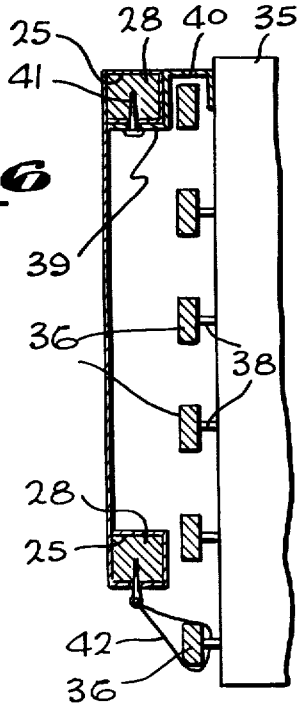

For example, the marquee 35 (FIG. 6) may be of the type from which a plurality of horizontal tracks 36 extend. The tracks are fastened to the marquee by spaced-apart clips 38. One way of attaching frame 33 to the marquee is to fasten flanges (see FIG. 6) 39 of channel-forming clips 40 to the members 28 of the top unit 31, such as by means of nails 41. The entire frame 33 with sheet 20 is then supported by placing the clips 40 over a top track 36 of the marquee 35. Wires 42, extending at several locations along the length of the bottom unit 32, may then be pulled and tied to a bottom track 36 in order to attach the bottom side of the frame-supported sheet 20 securely to the marquee. If desired, wires may also be used to pull the side members 28 of frame 33 tightly against the marquee. It should again be stressed that since the sheet 20 with its support frame 33 are very light, even though the frame dimensions may be large, one worker can attach the frame to a marquee.

Herebefore, it was assumed that sheet 20 is formed of a single sheet of pennant cloth of the same color. The invention is not intended to be limited to it. If desired sheet 20 may be formed of two or more separate strips of pennant cloth of different colors so that letters on different rows may appear to have different colors. For diagrammatic purpose such two strips are represented in FIG. 3 by **20*a* and 20*b*. In such an arrangement the L would be of the color of strip 20*a* and the E of the color of strip 20*b***. Also, although herebefore the invention has been described in connection with a sheet made of pennant cloth which is a vinyl coated sheet, the sheet may be of other materials. To perform its functions, in accordance with the present invention, the sheet material has to be flexible so that it can be rolled up to simplify its shipment. It should preferably be of lightweight material. To enable light to pass through it, it should be semitransparent. Preferably it should be able to be colored, including being treated, so that the treated surfaces shall become opaque.

Examples of such materials are semitransparent construction paper, thinly woven cloth or the like. Preferably, the sheet material should be able to resist tearing due to wind forces. However, matter which is easily tearable may be used if the finished false front is to be installed in an enclosure with a transparent front glass.

The present invention is not intended to be limited to marquee false fronts. It can be used to form any display, particularly of reasonably large surface area. Due to its novel features the display can be produced at one location and easily shipped in folded up or rolled up form to the installation site. There, usually a single worker may install the light-weight display in spite of its reasonably large surface area.

Although particular embodiments of the invention have been described and illustrated herein, it is recognized that modifications and variation may readily occur to those skilled in the art and consequently, it is intended that the claims be interpreted to cover such modifications and equivalents.

The embodiments of the invention in which an exclusive property or privilege is claimed are defined as follows:

1. A display device for displaying at least word forming letters on a substantially flat surface comprising:

a sheet of a flexible rollable material, said sheet having a front surface and a back surface, said sheet being opaque over said front surface except for preselected letter-shaped areas through which light is adapted to pass from said back surface to said front surface; and means for tauting said sheet about its entire periphery to flatten it and its front surface, so that said areas through which light is adapted to pass are taut and flat to facilitate the passage of light therethrough, said sheet being of semitransparent matter of at least a first color, said sheets front surface except for the letter-shaped areas being coated with coating matter of a selected second color contrasting said first color, which substantially inhibits the passage of light therethrough, with the letter-shaped areas being of said first color, whereby when light passes from the sheet's back surface to the front surface through said areas, the latter are illuminated areas in said first color, said sheet defining a plurality of pocket-like members extending along the entire periphery of the sheet's back surface, and said tauting means include a plurality of separate interlockable members, which are insertable into said pocket-like members, for forming a continuous frame to taut said sheet thereon.

2. A display device for displaying at least word forming letters on a substantially flat surface comprising:

a sheet of a flexible rollable material, said sheet having a front surface and a back surface, said sheet being opaque over said front surface except for preselected letter-shaped areas through which light is adapted to pass from said back surface to said front surface; and means for tauting said sheet about its entire periphery to flatten it and its front surface, so that said areas through which light is adapted to pass are taught and flat to facilitate the passage of light therethrough, said sheet comprising of at least first and second strips of different colors of semitransparent cloth-like material, said first and second strips being sewn along one edge to form two adjacent strips of said sheet, and said sheet's front surface except for the letter-shaped areas being coated with coating matter which substantially inhibits the passage of light therethrough, said coating matter being of a third color contrasting said first and second colors, said sheet defining a plurality of pocket-like members extending along the periphery of the sheet's back side, and said tauting means include interlockable members insertable into said pocket-like members for forming a frame to taut said sheet thereon.

3. A display device as described in claim 2 wherein said display device is of the type adapted to be attached to a theatre marquee to form the front face thereof, and said tauting means further include means attachable to said frame and to said marquee for attaching said frame with said sheet taut thereon to said marquee.

* * * * *